US006818266B2

(12) United States Patent
Takahashi et al.

(10) Patent No.: US 6,818,266 B2
(45) Date of Patent: Nov. 16, 2004

(54) BACKPRINTING RECORDING MEDIUM

(75) Inventors: Jun Takahashi, Kanuma (JP); Takashi Nozawa, Kanuma (JP); Hideaki Takahashi, Kanuma (JP)

(73) Assignee: Sony Chemicals Corp., Tokyo (JP)

( * ) Notice: Subject to any disclaimer, the term of this patent is extended or adjusted under 35 U.S.C. 154(b) by 0 days.

(21) Appl. No.: 09/729,168

(22) Filed: Dec. 5, 2000

(65) Prior Publication Data

US 2001/0006720 A1 Jul. 5, 2001

(30) Foreign Application Priority Data

Dec. 13, 1999 (JP) ..... 11-352756

(51) Int. Cl.[7] ..... B41M 5/40

(52) U.S. Cl. ..... 428/32.13; 428/32.15; 428/32.34

(58) Field of Search ..... 428/32.13, 32.15, 428/32.34, 195, 217, 323, 480, 500

(56) References Cited

U.S. PATENT DOCUMENTS

| | | | | | |
|---|---|---|---|---|---|
| 4,686,118 | A | * | 8/1987 | Arai et al. | 427/261 |
| 4,877,678 | A | | 10/1989 | Hasegawa et al. | |
| 4,903,041 | A | * | 2/1990 | Light | 346/1.1 |
| 5,025,061 | A | * | 6/1991 | Ishidoya et al. | 524/539 |
| 5,027,131 | A | * | 6/1991 | Hasegawa et al. | 346/1.1 |
| 5,683,793 | A | | 11/1997 | Malhotra et al. | |
| 5,985,425 | A | * | 11/1999 | Tomizawa et al. | 428/212 |
| 6,013,354 | A | * | 1/2000 | Tomizawa et al. | 428/206 |
| 6,139,940 | A | * | 10/2000 | Iwamoto et al. | 428/195 |
| 6,335,085 | B1 | * | 1/2002 | Asano et al. | 428/195 |

FOREIGN PATENT DOCUMENTS

| | | | |
|---|---|---|---|
| DE | 3523269 | | 1/1986 |
| EP | 0 286 427 | | 10/1988 |
| EP | 0 633 508 | | 1/1995 |
| EP | 0 696 516 | | 2/1996 |
| EP | 0 818 322 | A1 * | 1/1998 |
| EP | 0 841 185 | A1 * | 5/1998 |
| EP | 0 841 185 | | 5/1998 |
| JP | 62-034176 | | 2/1987 |
| JP | 62-242576 | | 10/1987 |
| JP | 62-261476 | | 11/1987 |
| JP | 4-265785 | | 9/1992 |
| JP | 6-219042 | | 8/1994 |
| JP | B2 6-71822 | | 9/1994 |
| JP | 8-164666 | | 6/1996 |
| JP | 9-188065 | | 7/1997 |
| JP | A 10-211763 | | 8/1998 |
| JP | 10-329410 | | 12/1998 |
| JP | 11-005362 | | 1/1999 |
| JP | 2000-313084 | | 11/2000 |
| WO | WO 98/05512 | | 2/1998 |

* cited by examiner

*Primary Examiner*—B. Shewareged
(74) *Attorney, Agent, or Firm*—Oliff & Berridge, PLC

(57) ABSTRACT

A backprinting recording medium includes a transparent substrate, an ink-absorbing layer formed on the transparent substrate and a porous ink-permeable layer formed on the ink-absorbing layer and produced by dispersing a filler in a binder resin, wherein the binder resin constituting the ink-permeable layer has a glass transition temperature of 10° C. or higher, and a Shore D hardness at 25° C. of 40 or higher.

3 Claims, 1 Drawing Sheet

BACKPRINTING RECORDING MEDIUM

BACKGROUND OF THE INVENTION

1. Field of the Invention

The present invention relates to a backprinting recording medium.

2. Description of the Related Art

Backprinting recording media are known as a class of recording media used in ink-jet recording systems. Typical backprinting recording media are configured such that an ink-absorbing layer composed of a resin material capable of absorbing and fixing an ink-jet recording ink is formed on a transparent substrate such as a polyester sheet, and a porous ink-permeable layer produced by dispersing a filler in a binder resin (Japanese Patent Application Laid-open No. 10-211763, Japanese Patent Publication No. 6-71822) is formed on the ink-absorbing layer. When ink-jet recording is performed on such backprinting recording media, the ink jetted on the ink-permeable layer penetrates from the surface of the ink-permeable layer through the layer, and reaches the ink-absorbing layer, where the ink is absorbed and fixed by the ink-absorbing layer. Ink images are thus formed in the ink-absorbing layer. The ink images thus formed are viewed through the transparent substrate.

The above-described backprinting recording media are disadvantageous, however, in that the ink-permeable layer has insufficient coating strength. The result is that when recording is performed on a backprinting recording medium in an ink-jet printer, the porous structure of the ink-permeable layer is damaged in the areas where the medium is pressed down with the feed rollers of the printer, ink permeability decreases in these areas, and the quality of the ink images is deteriorated. When the ink images are viewed in transmitted light, there is a difference in light transmittance between areas of reduced ink permeability (compressed areas) and areas of normal ink permeability (uncompressed areas), and the ink images acquire visible feed roller marks.

It has been suggested that this shortcoming can be overcome by increasing the content of binder resin in the ink-permeable layer and enhancing the coating strength of this layer, but this approach has the unwanted effect of reducing the ink permeability of the ink-permeable layer and preventing the ink-absorbing layer from absorbing the amount of ink necessary to form high-quality images.

SUMMARY OF THE INVENTION

An object of the present invention is to provide high-quality ink images while an ink-permeable layer is prevented from losing some of its ink permeability when a backprinting recording medium is pressed down with the feed rollers of a printer, and no feed roller marks can be seen when the ink image is viewed in transmitted light.

The inventors perfected the present invention upon discovering that the ink permeability and coating strength of the ink-permeable layer of a backprinting recording medium is closely associated with the Shore D hardness and glass transition temperature of the binder resin used.

Specifically, the present invention provides a backprinting recording medium, comprising a transparent substrate, an ink-absorbing layer formed on the transparent substrate and a porous ink-permeable layer formed on the ink-absorbing layer and produced by dispersing a filler in a binder resin, wherein the binder resin constituting the ink-permeable layer has a glass transition temperature of 10° C. or higher, and a Shore D hardness at 25° C. of 40 or higher. As referred to herein, the glass transition temperature of the binder resin may preferably be 130° C. or lower, and the Shore D hardness (25° C.) may preferably be 90 or lower.

DESCRIPTION OF THE PREFERRED EMBODIMENT

Figure 1:
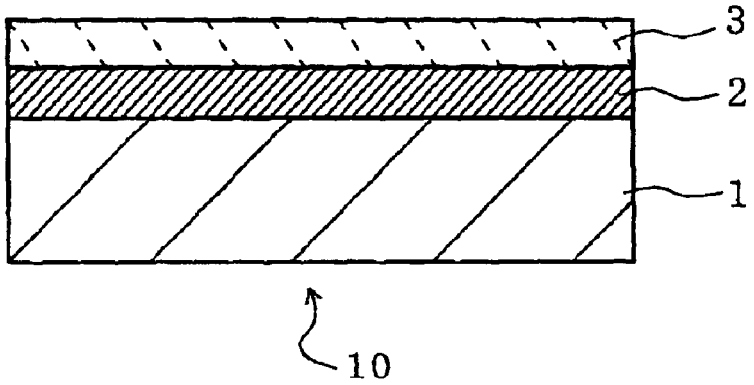
FIG. 1 is a cross section of the backprinting recording medium of the present invention.

The backprinting recording medium of the present invention will now be described in detail.

The backprinting recording medium 10 of the present invention is configured such that an ink-absorbing layer 2 is formed on a transparent substrate 1, and an ink-permeable layer 3 is formed on the ink-absorbing layer 2, as shown in FIG. 1. As referred to herein, the ink-absorbing layer 2 is an ink-absorbing and fixing layer, with ink images formed inside this layer. In addition, the ink-permeable layer 3 is a layer that is provided with a porous structure obtained by dispersing a filler in a binder resin and that is designed to allow an ink fed from the outside to be fed through this layer to the ink-absorbing layer 2.

The binder resin constituting the ink-permeable layer 3 should have a glass transition temperature of 10° C. or higher (preferably 25° C. or higher) and a Shore D hardness at 25° C. of 40 or higher (preferably 50 or higher) A glass transition temperature below 10° C. is unsuitable because such a temperature reduces the coating strength of the ink-permeable layer 3 and creates feed roller marks on the ink images. In addition, a Shore D hardness (JIS Z-2246) at 25° C. of less than 40 is unsuitable because such a hardness reduces the coating strength of the ink-permeable layer 3 and creates feed roller marks on the ink images.

Furthermore, a binder resin with an excessively high glass transition temperature causes flexibility of the ink-permeable layer 3 to become deteriorated. Consequently, the glass transition temperature may preferably be 130° C. or lower, and more preferably 100° C. or lower. Furthermore, the ink-permeable layer 3 becomes brittle when the Shore D hardness (25° C.) is too high, so the hardness may preferably be 90 or lower, and more preferably 80 or lower.

Examples of binder resins that have the above-described characteristics and can be used for the ink-permeable layer 3 include polyester-based resins, polyvinyl alcohol-based resins, polyvinyl butyral-based resins, polyvinyl acetate-based resins, styrene-butadiene rubber, acrylic resins, acrylic emulsions, and polyamide resins. Of these, polyester-based resins are preferred because of their low ink absorbability, high coating strength, and enhanced flexibility.

Examples of fillers that can be used for the ink-permeable layer 3 include silica, alumina, talc, calcium carbonate, and plastic fine particles. Of these, silica is preferred because of its high degree of whiteness and chemical stability.

An excessively fine filler increases the viscosity of the coating solution and deteriorated coating strength, whereas an excessively coarse filler settles down in the coating solution, has an adverse effect on the outward appearance of the coating film, and deteriorates quality. Consequently, the filler should preferably measure 0.5–30 $\mu$m.

Taking into account ink permeability and coating strength, the amount of the binder resin in the ink-permeable layer 3 may preferably be 5–200 weight parts per 100 weight parts of filler.

Various additives (for example, whiteners) commonly used for the ink-permeable layers of conventional backprinting recording media may also be added as needed to the ink-permeable layer 3.

The thickness of the ink-permeable layer 3 is not subject to any particular limitations and is commonly 5–30 μm.

The ink-absorbing layer 2 may be composed of the same material as the ink-absorbing layer of a conventional backprinting recording medium. Examples of the material include water-soluble polyester resins, polyvinylpyrrolidone resins, polyvinyl alcohol-based resins, polyurethane, polyvinyl acetal, ethylene-vinyl acetate copolymers, acrylic resins, and other film-forming resins.

Various additives (for example, whiteners) commonly used for the ink-absorbing layers of conventional backprinting recording media may also be added as needed to the ink-absorbing layer 2.

The thickness of the ink-absorbing layer 2 is not subject to any particular limitations and is commonly 5–30 μm.

The transparent substrate 1 may be composed of the same material as the transparent substrate of a conventional backprinting recording medium. Examples of the material include polyester, polyethylene, polypropylene, polyamide, vinyl chloride, polycarbonate, and other film-forming materials.

The thickness of the transparent substrate 1 is not subject to any particular limitations and is commonly 10–500 μm.

The backprinting recording medium 10 of the present invention can be fabricated by a common method. According to one manufacturing example, the ink-absorbing layer 2 is formed by a technique in which a coating solution obtained by dissolving an ink-absorbing resin in an appropriate solvent is applied to the transparent substrate 1 with the aid of a bar coater, comma coater, or other conventional coating apparatus, followed by drying; and the ink-permeable layer 3 is formed by a technique in which a coating solution obtained by the uniform mixing of an ink-permeable binder resin and filler in an appropriate solvent is applied to the resulting ink-absorbing layer 2 with the aid of a conventional coating apparatus, followed by drying.

The above-described backprinting recording medium of the present invention can be appropriately used in an ink-jet recording system. The medium can also be used in other recording systems in which recording solutions are employed. For example, the medium can be used in recording systems featuring fountain pens, felt-tip pens, pen plotters, and the like.

EXAMPLES

The present invention will now be described in further detail through working examples.

Working Examples 1–7, Comparative Examples 1–3

(Formation of Ink-Absorbing Layer)

A coating solution designed for forming ink-absorbing layers and prepared by agitating the components shown in Table 1 for 3 hours in a jar mill was applied with the aid of a bar coater in a dry thickness of 15 μm to a transparent polyester film (Cosmoshine A4100, manufactured by Toyobo) with a thickness of 100 μm, and the coated film was dried for 3 minutes in a 120° C. hot-blast circulation oven, yielding an ink-absorbing layer.

TABLE 1

| Component | Weight parts |
|---|---|
| Water-soluble polyester resin (NS-122L, Takamatsu Oil & Fat) | 32.7 |
| Polyvinyl pyrrolidone (Luviskol K-90, BASF) | 2.1 |
| Deionized water | 29 |
| Aluminum hydroxide (H42, Showa Denko) | 3 |

(Formation of Ink-Permeable Layer)

The solvent components shown in Tables 2 and 3 were stirred in a dissolver, polyester resins A–G (see below) were added thereto. The resulting mixture was stirred for 2 hours to dissolve the polyester resins, silica (P-527, manufactured by Mizusawa Industrial Chemicals, mean grain size: 1.6 μm, specific surface: 55 $m^2/g$, oil absorptivity: 130) was added thereto. The resulting mixture was stirred for 1 hour, yielding coating solutions for ink-permeable layers. The coating solutions for ink-permeable layers were coated with the aid of a Myer bar to previously formed ink-absorbing layers in a dry thickness of 15 μm, and the coated layers were dried for 3 minutes in a 120° C. hot-blast circulation oven, yielding ink-permeable layers. Backprinting recording media were thus obtained.

Polyester resin A Number-average molecular weight: 17,000; Shore D hardness (25° C.)=80; glass transition temperature: 65.8° C.

Polyester resin B Number-average molecular weight: 22,000; Shore D hardness (25° C.)=20; glass transition temperature: −9.4° C.

Polyester resin C Number-average molecular weight: 20,000; Shore D hardness (25° C.)=70; glass transition temperature: 75° C.

Polyester resin D Number-average molecular weight: 15,000; Shore D hardness (25° C.)=70; glass transition temperature: 65° C.

Polyester resin E Number-average molecular weight: 20,000; Shore D hardness (25° C.)=70; glass transition temperature: 45° C.

Polyester resin F Number-average molecular weight: 30,000; Shore D hardness (25° C.)=60; glass transition temperature: 35° C.

Polyester resin G Number-average molecular weight: 25,000; Shore D hardness (25° C.)=33; glass transition temperature: 5° C.

Tables 2 and 3 show measurements results obtained as described below concerning the glass transition temperature and Shore D hardness (25° C.) of the polyester resins used.

(Shore D Hardness)

An MEK solution (solid content: 50%) of a polyester resin was prepared, this solution was placed in an aluminum dish coated with a release agent, and the solution in the dish was dried for 24 hours in a 120° C. oven, yielding a polyester resin sheet. The Shore D hardness of the resulting polyester resin sheet was measured according to JIS Z-2246. When several polyester resins were used, the Shore D hardness was measured using polyester resin sheets fabricated in the same manner from mixed polyester resins whose mixing ratios are shown in Tables 2 and 3.

(Glass Transition Temperature)

Some of the polyester resin sheets used in the Shore D hardness measurements were used as test samples, and their glass transition temperatures were measured with the aid of a differential scanning calorimeter (DSC6200, manufactured by Seiko Denshi Kogyo).

TABLE 2

(Weight parts)

| | Working Examples | | | Comparative Examples | |
|---|---|---|---|---|---|
| Components | 1 | 2 | 3 | 1 | 2 |
| Silica | 30 | 30 | 30 | 30 | 30 |
| Polyester resin (binder resin) | | | | | |
| A | 30 | 21 | 15 | 9 | — |
| B | — | 9 | 15 | 21 | 30 |
| (Shore D hardness | 80 | 62 | 50 | 38 | 20) |
| (Glass transition temperature (° C.) | 65.8 | 41.2 | 23.1 | −4.7 | −9.4) |
| Methyl ethyl ketone | 112 | 112 | 112 | 112 | 112 |
| Cyclohexanone | 28 | 28 | 28 | 28 | 28 |
| Total | 200 | 200 | 200 | 200 | 200 |
| Solid content (%) | 30 | 30 | 30 | 30 | 30 |

TABLE 3

(Weight parts)

| | Working Examples | | | | Comparative Example |
|---|---|---|---|---|---|
| Components | 4 | 5 | 6 | 7 | 3 |
| Silica | 30 | 30 | 30 | 30 | 30 |
| Polyester resin (binder resin) | | | | | |
| C | 30 | — | — | — | — |
| D | — | 30 | — | — | — |
| E | — | — | 30 | — | — |
| F | — | — | — | 30 | — |
| G | — | — | — | — | 30 |
| (Shore D hardness | 70 | 70 | 70 | 60 | 33) |
| (Glass transition temperature (° C.) | 75 | 65 | 45 | 35 | 5) |
| Methyl ethyl ketone | 112 | 112 | 112 | 112 | 112 |
| Cyclohexanone | 28 | 28 | 28 | 28 | 28 |
| Total | 200 | 200 | 200 | 200 | 200 |
| Solid content (%) | 30 | 30 | 30 | 30 | 30 |

(Print Evaluation)

The backprinting recording media obtained in Working Examples 1–7 and Comparative Examples 1–3 were each cut to A4 size, a test pattern with 720-dpi resolution was printed thereon in four passes using an ink-jet printer (FJ-40, manufactured by Roland), and the presence or absence of feed roller marks was visually evaluated, as was the quality of printed images.

As a result, no visible feed roller marks had formed on the backprinting recording media of Working Examples 1–7, in which polyester resins having a Shore D hardness (25° C.) of 40 or higher and a glass transition temperature of 10° C. or higher were used as the binder resins for the ink-permeable layers. In addition, the quality of images formed in the areas held between feed rollers was the same as the quality of images formed in the areas without any contact with the rollers. Overall, adequate images had been formed.

Meanwhile, visible feed roller marks had formed on the backprinting recording media of Comparative Examples 1–3, in which the Shore D hardness (25° C.) was less than 40 and the glass transition temperature was less than 10° C., and image clarity was deteriorated in these areas. In addition, the backprinting recording media was viewed in transmitted light, and striped spot patterns were found at even unprinted areas because of a reduced light transmittance of the feed roller marks.

According to the present invention, an ink-permeable layer can be prevented from losing some of its ink permeability when a backprinting recording medium is pressed down with the feed rollers of a printer, and no feed roller marks can be seen when the ink image is viewed in transmitted light, whereby high-quality ink images can be obtained.

What is claimed is:

1. A backprinting recording medium, comprising a transparent substrate, an ink-absorbing layer formed on the transparent substrate and a porous ink-permeable layer formed on the ink-absorbing layer, wherein said porous ink-permeable layer produced by dispersing a filler in a binder resin, wherein:

the binder resin includes a first polyester resin and a second polyester resin, the resins being present in a ratio of from 1:1 to 7:3 of the first polyester resin to the second polyester resin;

the first polyester resin has a glass transition temperature of from 35° C. to 80° C. and a Shore D hardness at 25° C. of from 60 to 80;

the second polyester resin has a glass transition temperature of less than 35° C. and a Shore D hardness at 25° C. of less than 60; and the binder resin has a glass transition temperature of 23.1° C. to 41.2° C., and a Shore D hardness at 25° C. of from 50 to 62.

2. The backprinting recording medium as defined in claim 1, wherein the filler measures 0.5 to 30 $\mu$m.

3. The backprinting recording medium as defined in claim 1, wherein the binder resin is present in an amount of 5 to 200 weight parts per 100 weight parts of filler.

* * * * *